US007148435B2

(12) United States Patent
Lau et al.

(10) Patent No.: US 7,148,435 B2
(45) Date of Patent: Dec. 12, 2006

(54) BUILD-IN LOTO DEVICE ON EQUIPMENT BREAKER PANEL

(75) Inventors: Allen K. Lau, Cupertino, CA (US); Michael Rosenstein, Sunnyvale, CA (US); Carl Johnson, Tracy, CA (US); Sharon Niehoff, Morgan Hill, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/312,235

(22) Filed: Dec. 20, 2005

(65) Prior Publication Data

US 2006/0151306 A1 Jul. 13, 2006

Related U.S. Application Data

(60) Provisional application No. 60/637,899, filed on Dec. 21, 2004.

(51) Int. Cl.
*H01H 9/00* (2006.01)

(52) U.S. Cl. ..... 200/43.14; 200/50.32

(58) Field of Classification Search ..... 200/43.01, 200/43.11–43.16, 43.19, 43.21, 50.01, 50.02, 200/50.11, 321, 322, 334
See application file for complete search history.

(56) References Cited

U.S. PATENT DOCUMENTS

| | | | | |
|---|---|---|---|---|
| 4,174,472 | A | 11/1979 | Josemans | |
| 4,591,816 | A | 5/1986 | Mikulecky et al. | |
| 5,122,624 | A | 6/1992 | Benda | |
| 5,270,503 | A | 12/1993 | Frye | |
| 5,453,724 | A | 9/1995 | Seymour et al. | |
| 5,502,286 | A | 3/1996 | Pollman et al. | |
| 5,631,798 | A | 5/1997 | Seymour et al. | |
| 5,655,648 | A | 8/1997 | Rosen et al. | |
| 5,772,007 | A | 6/1998 | Frye | |
| 5,821,487 | A | 10/1998 | Groves et al. | |
| 5,936,535 | A | 8/1999 | Rosen et al. | |
| 5,960,941 | A | 10/1999 | Castonguay et al. | |
| 5,981,888 | A | 11/1999 | Robarge et al. | |
| 6,015,956 | A * | 1/2000 | Green | 200/43.14 |
| 6,054,661 | A | 4/2000 | Castonguay et al. | |
| 6,266,231 | B1 * | 7/2001 | Donahue et al. | 361/631 |
| 6,403,902 | B1 | 6/2002 | Castonguay et al. | |
| 6,501,628 | B1 | 12/2002 | Namba et al. | |
| 6,563,063 | B1 * | 5/2003 | Moore | 200/50.33 |
| 6,927,349 | B1 * | 8/2005 | Flegel et al. | 200/50.32 |
| 7,005,590 | B1 * | 2/2006 | Willis | 200/50.32 |
| 2004/0159530 | A1 | 8/2004 | Benda | |

* cited by examiner

*Primary Examiner*—Michael A. Friedhofer
(74) *Attorney, Agent, or Firm*—Patterson & Sheridan, LLP

(57) ABSTRACT

An apparatus for a lock out/tag out device that is a permanent attachment to a standard breaker box is disclosed. The device is designed to prevent movement of an electrical breaker handle to a closed position when the device is in use. The device also prevents locking a breaker in an on position, thereby lowering safety concerns. When the device is not in use, the device will not interfere with the operation of the breakers and stays conveniently attached to the breaker box. The device also allows storage of locking devices when not in use, thereby enabling personnel to perform a service procedure more efficiently.

20 Claims, 2 Drawing Sheets

BUILD-IN LOTO DEVICE ON EQUIPMENT BREAKER PANEL

CROSS REFERENCE TO RELATED APPLICATIONS

This application claims benefit of U.S. provisional patent application Ser. No. 60/637,899, filed Dec. 21, 2004, which is incorporated herein by reference.

BACKGROUND OF THE INVENTION

1. Field of the Invention

Embodiments of the present invention generally relate to a circuit breaker lock out/tag out ("LOTO") device that is mounted to a circuit panel.

2. Description of the Related Art

For many years, safety concerns for operator and maintenance personnel servicing equipment in an industrial setting have been at the forefront of the particular industry and federal and state lawmaking bodies. The Occupational Safety and Health Administration (OSHA) has implemented regulations that require employers to safeguard personnel by locking out and tagging out electrical circuit breakers to prevent energization of equipment while it is being serviced. This procedure, when practiced, can prevent serious injury or death to personnel in the vicinity of the particular equipment.

Prior art mechanical devices have been created to prevent movement of the toggle type switch or handle of a modern electrical circuit breaker in the open (off) or closed (on) position. The devices are in the form of clamshells, pins, or some type of moderately hard material that is shaped or designed to mechanically block the toggle from moving. These devices, when attached or put in position can then be stabilized with the use of a locking device, such as, a standard padlock, only permitting movement of the toggle when the padlock is removed and the installation or positioning steps are reversed. The prior art devices have serious drawbacks in that the devices enable locking a circuit breaker in a closed position, and the devices are not integral to the breaker box.

Circuit breakers are designed to move or "trip" to the open position when an electrical current reaches a determined potential. Most standard breakers will "trip" even though the handle may be secured by a prior art device and the circuit protection will be enabled. While locking a circuit breaker in a closed position may be needed in some situations such as preventing vandals from flipping a breaker, this is not useful in an industrial setting. A machine may be damaged or personnel may be seriously injured if an operator is not able to de-energize the machine or sub-system at will.

The prior art devices are also not integral to the breaker panel, existing as discrete devices. These devices are usually kept in a central location in a facility that maintenance personnel will have to retrieve when needed. Production quotas and schedules may prevent the personnel from retrieving the device if a minor repair or alteration needs to be performed. These devices may also be misplaced after use, which will add to the down time of the machine if the employee has to search for the device. Some of these devices are difficult to install and require special training to use.

The lock out/tag out procedure has been in existence longer than the OSHA regulation and is a common-sense approach to servicing a machine. Maintenance workers may have good intentions and are often required to disable the energy source to the particular piece of equipment or sub-system that they intend to repair or alter. Production quotas or managerial pressures may force these workers to forego this basic safety step in order to get the machine back "on-line" if the LOTO device is not convenient.

Therefore, there is a need in the art for a lock out/tag out device that is simple to use, cannot lock a breaker in the closed or "on" position, and is built in to the breaker panel for convenient use.

SUMMARY OF THE INVENTION

The present invention generally relates to a lock out device for a circuit breaker mounted in a circuit breaker box, the circuit breaker having an operating handle to allow an operator to move the breaker between an open and closed position. The lock out device has at least one swivel plate rotatably coupled to the breaker box and movable between a first position that permits locking the operating handle in the open position, and a second position that allows movement of the operating handle to a closed position, wherein the at least one swivel plate rotates about an axis that is substantially orthogonal to the movement of the operating handle.

In another embodiment, a lock out device is described for a plurality of circuit breakers mounted in a circuit breaker box, each circuit breaker having an operating handle movable between an open and closed position. The lock out device comprising an enclosure having a plurality of shelves, and a plurality of swivel plates mounted to the enclosure and movable between a first position that permits locking the operating handle in the open position and a second position that allows movement of the operating handle to a closed position.

In another embodiment, a lock out device for a circuit breaker mounted in a circuit breaker box is described, the circuit breaker having an operating handle movable between an open and closed position. The lock out device comprises an engaging means to prevent movement of the operating handle to the closed position, a means for supporting the engaging means, said means to support coupled to the breaker box, and a means for securing the engaging means to prevent movement of the engaging means, wherein the means for securing is coupled to the means for supporting.

In another embodiment, a method for servicing an electrically actuated machine or component is described, wherein the electrical actuation is controlled at least partially by a circuit breaker mounted on a breaker panel. The method includes the steps of providing the circuit breaker having a movable handle in a closed position, moving the handle to an open position, positioning a swivel plate coupled to the breaker panel to maintain the handle in the open position, positioning a restriction member in a perforation adjacent the swivel plate to maintain the position of the swivel plate, and servicing the machine or component.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention discloses a built-in lock out device configured for connection to a standard breaker panel with minimal installation. The circuit breakers as described herein are standard circuit breakers known in the art and industry, but may be any apparatus having an integral exposed member capable of movement in at least two positions-one of the positions may close an electrical circuit and the other position may open the electrical circuit. Examples include switches and toggles. The breaker locking mechanism is integral to the device, and cannot be lost or misplaced. The lock out device is also capable of not allowing a standard circuit breaker to be locked "on", thereby preventing possible fire hazards, machine damage, or injury to personnel.

Figure 1:
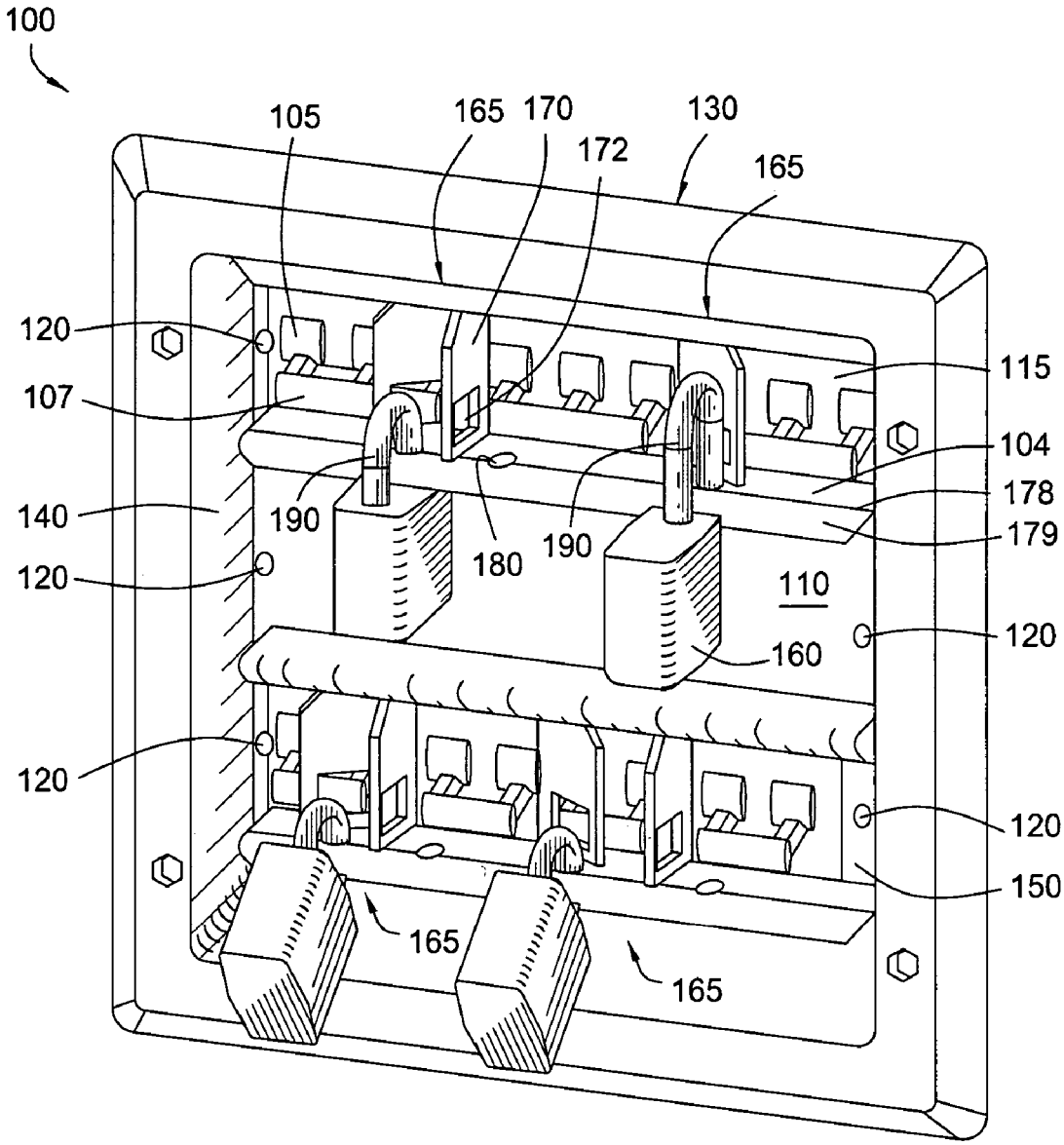
FIG. 1 is an isometric view of one embodiment of a lock-out device coupled to a breaker box.

FIG. 1 depicts a breaker box 100 with a built-in lock out device 110 attached. The breaker box 100 is a standard breaker box known in the art having a front panel 130 and a recess 140 in the panel 130 that is adapted to receive and house a plurality of standard circuit breakers 105. The breaker box 100 may be mounted on or near a piece of machinery that it serves by providing electrical power at the will of the user of the machinery by actuating a protruding handle 107 of the breaker 105. The lock out device 110 also contains a plurality of swivel plates 170 coupled to an extended member 104 that is part of a lockout assembly 165 that is coupled to the lock out device 110.

A frame 150 of the lock out device 110 is coupled to the breaker box 100. The frame 150 has an opening or cavity 115 that is adapted to provide clearance for the breakers 105 and allow free movement of the protruding handles 107. Each of the handles 107 is configured to provide one of two positions to the user. The handles 107 seen in FIG. 1 are in an "off" or open position that transmits no electrical power to the machine or components it serves. The "on" or closed position 220 of the handle 107 is shown in FIG. 2 in phantom and signifies a closed circuit denoting electrical power to the machine.

The lock out device 110 may be attached to the breaker box 100 by experienced service personnel using appropriate fasteners such as, self drilling, self tapping screws 120 in the frame 150 of the lock out device 110. The frame 150 is adapted to fit into the recess 140 and to allow free movement for the handles 107.

Figure 2:
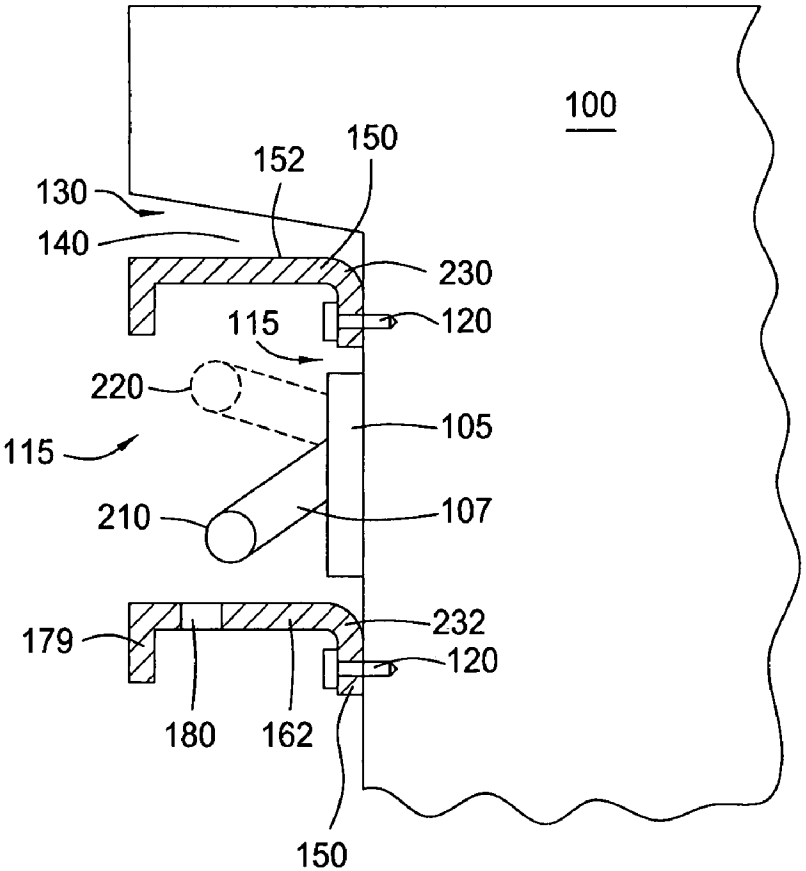
FIG. 2 is a side view of one embodiment of a lock-out device.

FIG. 2 is a side view of the breaker panel 130. Shown is the frame 150 in relation to the breaker 105 with the handle 107 shown in an open position 210. Also shown are the screws 120 through the frame 150 and the breaker panel 130. An opening 115 allows access for the breaker 105 and is shown in the area adjacent the breaker 105. Also shown is a first end 230 and a second end 232 of the frame 150 that will be described in detail below.

Figure 3:
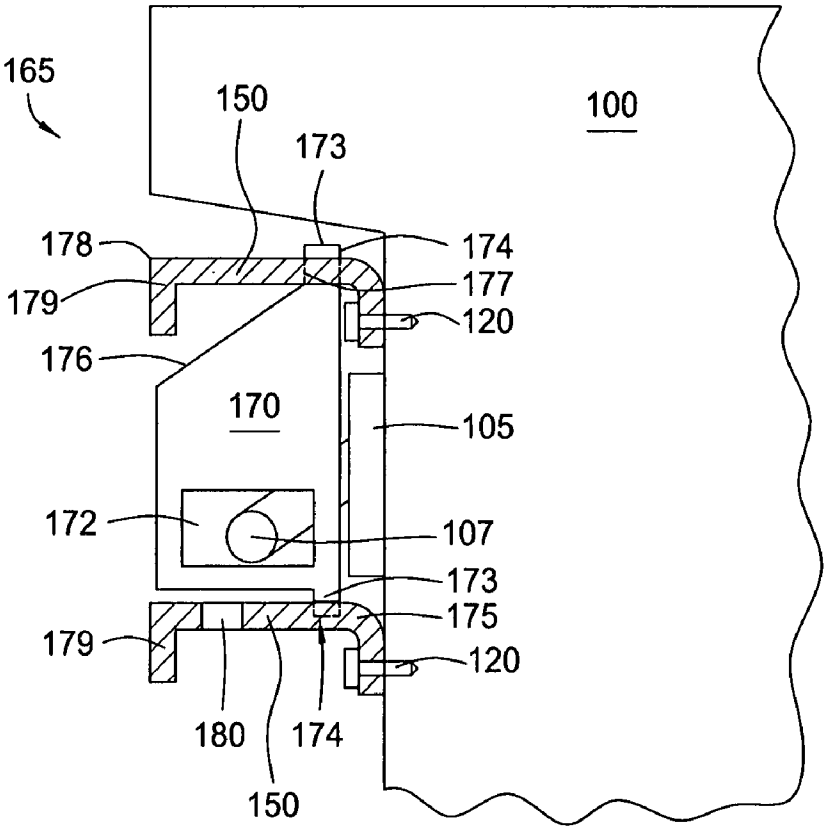
FIG. 3 is a side view of another embodiment of a lock-out device.

FIG. 3 is a side view of a lock out assembly 165. Shown is a swivel plate 170 that is pivotally mounted to the frame 150 by two hinge devices 174. The frame 150 includes at least a shelf 179, which is integral to, or otherwise coupled to, the frame 150. In this embodiment, there is one swivel plate 170 for each breaker 105 or handle 107. The swivel plate 170 may be fabricated from sheet metal and configured to have projections 173 on opposite ends that are adapted to mate with a full perforation 177 or a partial perforation 175 disposed in the frame 150. The swivel plate 170 has an opening 172 that is adapted to receive the protruding handle 107 of the breaker 105 when it is in an open or "off" position. The swivel plate also has a chamfered edge 176 that is adapted to provide clearance for a break or bend 178 of the frame 150. The bend 178 is adapted to provide increased mechanical strength to the shelf 179.

In reference to FIGS. 1, 2 and 3, the operation of the lock out device 110 will now be described. When the protruding handle 107 of the breaker 105 is in an "off" or open position 210, a swivel plate 170 and its respective opening 172 will allow the swivel plate 170 to be pivoted to engage and secure the handle 107, thereby holding the handle 107 and preventing movement of the handle 107 to position 220.

To prevent movement of the swivel plate 170, a restriction member is inserted into one of the perforations 180 adjacent the swivel plate 170. In one embodiment, the restriction member is a shackle 190 of a locking device 160. The shackle 190 is placed into one of the perforations 180 formed through the shelf 179, thereby preventing pivoting of the swivel plate 170 away from the handle 107. Once the padlock 160 is in a locked position, service personnel can be assured that the breaker 105 will remain in an open position 210 until the padlock 160 is removed, and maintenance may commence. In another embodiment, the restriction member may be a lockout hasp that is known in the art. In another embodiment, the restriction member is a cable from a locking device known in the art to lock a plurality of breakers 105. The cable is a size and material that prevents lateral movement of the swivel plate 170, and is of sufficient length to be threaded through at least one of the perforations 180. The cable itself is then locked to prevent removal of the cable from the perforation 180, thereby preventing movement of the swivel plates 170 and the respective protruding handles 107.

The construction of the swivel plate 170 prevents securing the handle 107 when it is in a closed position 220 due to the absence of an opening 172 adapted to secure the handle 107 in the closed position, thereby preventing locking a breaker 105 in an "on" position 220. This results in increased safety to any corresponding equipment or personnel by allowing an operator or bystander to open the circuit at will if a problem develops and the machine should be de-energized. The adjacent perforations 180 are in a spaced apart relation to the protruding handles 107, thereby allowing free movement to the handle 107. When the swivel plate 170 is not in use and the breakers 105 are in the closed or "on" position, the plate 170 may be positioned so as not to interfere with the handles 107 and secured by a restriction member as discussed above. This results in unfettered operation of the breakers 105 while providing convenient storage for the restriction members, such as the shackles 190 of the padlocks 160.

In one embodiment shown in FIGS. 1, 2, & 3, the lock out device 110 may be an enclosure 102 adapted to mount on a standard circuit breaker box, having a rectangular frame 150 with a first protrusion 152 on a first end 230 and having a second protrusion 162 on a second end 232, the first and second protrusions 152, 162 being substantially parallel and perpendicular to the rectangular frame 150. The protrusions 152 and 162 may also facilitate prevention of accidental tripping of the circuit breaker 105 by providing a guard for the handle 107, thereby preventing the circuit breaker 105 from tripping due to bumping by personnel or other objects. A cavity 115 is disposed in the frame 150 between the first and second protrusions 152, 162 and is adapted to allow access to a circuit breaker 105 and its protruding handle 107. At least one swivel plate 170, having a body including a chamfered end 176, and an opening 172 disposed through the body, is pivotally mounted adjacent the cavity 115 and the handle 107. The at least one swivel plate 170 is substantially parallel to the first and second protrusions 152, 162. The second protrusion 162 has a perforation 180 formed therethrough that is adjacent the swivel plate 170 and is adapted to receive the shackle 190 of a padlock 160, thereby preventing movement of the swivel plate 170.

In another embodiment (not shown), a swivel plate 170 may be rotatably coupled to the face of the breaker box 100 adjacent a standard circuit breaker 105 without the need for a protrusion 152, 162 or a shelf 179. The face of the breaker box 100 may be suitably formed to allow the swivel plate 170 to rotate about an axis that is substantially orthogonal to the movement of the protruding handle 107 of the circuit breaker 105, thereby allowing the opening 172 of the swivel plate 170 to pivot and engage the handle 107 in the open position when used. The swivel plate 170 could then be secured by a restriction member holding means that could be formed integrally with, or coupled to the breaker box 100 face adjacent the swivel plate, thereby providing means to prevent further movement of the swivel plate 170 and providing a storage location for the restriction member.

In another embodiment (not shown), a swivel plate 170 may be rotatably coupled to the face of the breaker box 100 adjacent a standard circuit breaker 105 above or below (or to either side in the case of a horizontally mounted circuit breaker) the protruding handle 107, thereby allowing the swivel plate 170 to pivot in a substantially parallel relation to the movement of the protruding handle 107. The swivel plate 170 could then be secured by a restriction member holding means that could be formed integrally with, or coupled to the breaker box 100 face adjacent the swivel plate, thereby providing means to prevent further movement of the swivel plate 170 and providing a storage location for the restriction member.

While the foregoing is directed to embodiments of the present invention, other and further embodiments of the invention may be devised without departing from the basic scope thereof, and the scope thereof is determined by the claims that follow.

This invention claimed is:

1. A lock out device for a circuit breaker mounted in a circuit breaker box, the circuit breaker having an operating handle movable between an open and closed position, comprising:

at least one swivel plate rotatably coupled to the circuit breaker box and movable between a first position that permits locking the operating handle in the open position and a second position that allows movement of the operating handle to a closed position, wherein the at least one swivel plate rotates about an axis that is substantially orthogonal to the movement of the operating handle.

2. The device of claim 1, further comprising:

a shelf having a perforation positioned to receive a shackle of a locking device to prevent movement of the handle from the open position to the closed position while allowing movement of the handle from the closed position to the open position.

3. The device of claim 2, further comprising:

a locking device, wherein a shackle of the locking device is disposed in the perforation to prevent movement of the swivel plate.

4. The device of claim 1, wherein the at least one swivel plate further includes an opening positioned to engage the handle and secure the handle in the open position.

5. A lock out device for a plurality of circuit breakers mounted in a circuit breaker box, each circuit breaker having an operating handle movable between an open and closed position, comprising:

an enclosure having at least one shelf; and a plurality of swivel plates mounted to the enclosure and movable between a first position that permits locking the operating handles in the open position and a second position that allows movement of the operating handles to the closed position.

6. The device of claim 5, wherein the plurality of shelves further comprise a plurality of perforations, each of the perforations configured to receive a restriction member to prevent movement of one of the handles from the open position to the closed position while allowing movement of the handle from the closed position to the open position.

7. The device of claim 6, further comprising a plurality of locking devices, wherein a shackle of each of the locking devices is disposed in one of the perforations to prevent movement of one of the swivel plates.

8. The device of claim 5, wherein each of the plurality of swivel plates further includes an opening positioned to engage one of the handles and secure the handle in the open position.

9. A lock out device for a circuit breaker mounted in a circuit breaker box, the circuit breaker having an operating handle movable between an open and closed position, comprising:

engaging means to prevent movement of the operating handle to the closed position;

means for rotatable supporting the engaging means, said means to support coupled to the breaker box; and means for securing the engaging means to prevent movement of the engaging means, wherein the means for securing is coupled to the means for supporting.

10. The look out device of claim 9, wherein the engaging means is movable between a first position that allows movement of the operating handle and a second position that prevents movement of the operating handle.

11. The lock out device of claim 9, wherein the means for rotatably supporting the engaging means is a shelf coupled to the breaker box.

12. The lock out device of claim 11, wherein the shelf has a perforation adjacent the engaging means.

13. The lock out device of claim 9, wherein the means for securing is a restriction member.

14. The lock out device of claim 9, wherein the means for securing is a shackle of a locking device.

15. A method for servicing an electrically actuated machine or component, wherein the electrical actuation is controlled at least partially by a circuit breaker mounted on a breaker panel; comprising:

providing the circuit breaker having a movable handle in a closed position;

moving the handle to an open position;

positioning a swivel plate coupled to the breaker panel to maintain the handle in the open position;

positioning a restriction member in a perforation adjacent the swivel plate to secure the handle in the open position; and servicing the machine or component.

16. The method of claim 15, wherein the restriction member is a shackle of a standard padlock.

17. The method of claim 15, wherein the restriction member is a lockout hasp.

18. The method of claim 15, wherein the swivel plate includes an opening adapted to receive the handle in an open position.

19. The method of claim 15, wherein the swivel plate is coupled to a shelf and the shelf is coupled to the breaker panel.

20. The method of claim 15, further comprising:

removing the restriction member from the perforation; and moving the handle to a closed position to restore electrical power to the machine or component.

* * * * *

UNITED STATES PATENT AND TRADEMARK OFFICE

CERTIFICATE OF CORRECTION

PATENT NO. : 7,148,435 B2
APPLICATION NO. : 11/312235
DATED : December 12, 2006
INVENTOR(S) : Lau et al.

It is certified that error appears in the above-identified patent and that said Letters Patent is hereby corrected as shown below:

Column 6, Claim 9, Line 34: Change “rotatable” to --rotatably--

Signed and Sealed this

Eighth Day of May, 2007

JON W. DUDAS
*Director of the United States Patent and Trademark Office*